United States Patent [19]

Hughes

[11] 4,412,568

[45] Nov. 1, 1983

[54] FILL VALVE

[75] Inventor: Richard E. Hughes, Hermosa Beach, Calif.

[73] Assignee: Otto K. Henke, San Pedro, Calif.

[21] Appl. No.: 295,644

[22] Filed: Aug. 24, 1981

[51] Int. Cl.[3] ..... B65B 3/04

[52] U.S. Cl. ..... 141/392; 137/114; 137/895; 141/67; 141/100; 239/410; 239/419.5; 239/428.5; 261/64 B; 261/DIG. 75

[58] Field of Search ..... 137/88, 98, 100, 114, 137/115, 888–895; 239/410–412, 8, 419.5, 311, 239/428.5; 261/64 B, DIG. 75; 141/1, 4, 37, 141/38, 46, 392, 67, 100

[56] References Cited

U.S. PATENT DOCUMENTS

| | | | |
|---|---|---|---|
| 1,750,742 | 3/1930 | Bradbury | 137/114 |
| 1,853,863 | 4/1932 | Hornbruch | 137/114 X |
| 2,341,618 | 2/1944 | Humphreys | 137/114 X |
| 3,042,314 | 7/1962 | Packard et al. | 239/311 X |
| 3,515,502 | 6/1970 | Coordes | 137/891 X |
| 3,762,439 | 10/1973 | Heath | 137/893 X |
| 3,906,996 | 9/1975 | DePass et al. | 137/893 |
| 3,961,754 | 6/1976 | Kuhns et al. | 239/311 X |
| 4,076,173 | 2/1978 | Taccon et al. | 239/412 X |
| 4,336,820 | 6/1982 | Jorgensen | 137/100 |

FOREIGN PATENT DOCUMENTS

| | | | |
|---|---|---|---|
| 647503 | 2/1979 | U.S.S.R. | 137/895 |

*Primary Examiner*—Houston S. Bell, Jr.
*Attorney, Agent, or Firm*—Cislo, O'Reilly & Thomas

[57] ABSTRACT

A fill valve, or aspirator, which is adapted to be connected to a superatmospheric pressure source, such as helium, and which is capable of intermixing at least two fluids in intimate fashion, wherein in one embodiment, actuation of a slide-like member allows introduction of a second fluid, for example, ambient atmosphere, so that ambient atmosphere is drawn into the fill valve by reason of a venturi effect due to the interior configuration of the fill valve so that an air and helium mixture may be obtained. The fill valve ideally, in the most efficacious embodiment may be utilized for filling inflatable members with a combination of air and helium so as to decrease the cost of the fluid for inflating the inflatable article. However, in other embodiments the fill valve may be used for other desirable end functions wherein it is desired to intimately intermix at least two fluids wherein one of the fluids is at a higher pressure than the other and due to the venturi construction of the interior of the fill valve, introduction of the second fluid is readily obtained for intimate intermixing with the higher pressure gas or fluid.

16 Claims, 6 Drawing Figures

FILL VALVE

BACKGROUND OF THE INVENTION

This invention pertains to fill valves, and particularly those of the type wherein it is desired to have intimate intermixing of two gaseous fluids.

In the inflatable article field, it is often times desirable to be able to inflate the inflatable articles with lighter than air gas, such as helium. However, the high cost of helium at present standards is such that to inflate an inflatable article entirely with helium becomes somewhat costly.

It becomes, therefore, necessary to be able to intermix helium with a less expensive gas, such as for example, air, but not at the point of the filling of the cylinders of gas since, to fill a cylinder with a combination of helium and air, is somewhat costly and is usually available in scientific grades only, which would not produce the decrease in costs that the present invention seeks.

Therefore, it becomes imperative, as for example, for low cost operations of filling inflatable articles such as balloons, to have ready access to ambient atmosphere or air in order to reduce the amount of helium that would otherwise be necessary to properly inflate the balloons. Thus, the fill valve of the invention is adapted to be connected to a source of superatmosphere helium or similar such gas, and actuated in a manner that surrounding atmosphere or ambient gas is drawn into the fill valve and intimately mixed with the helium at the time of filling of the inflatable article or balloon.

Thus, with the fill valve of the present invention, a first pressurized fluid being fed into the fill valve actuates a closure member thereby opening an orifice to the ambient air which is used to draw air into the fill valve by reason of its venturi interior configuration so that an intermixing of helium and air is obtained for filling an inflatable article.

The fill valve of the invention is provided with a metering means of a high degree of selectivity so that the amount of ambient atmosphere, or second fluid, being drawn into the fill valve, is selectively metered to fulfill a myriad of needs.

Thus, the invention is directed to a fill valve that permits lower cost inflating of inflatable articles. The prior art, as far as is known, has not suggested the fill valve of the present invention wherein a first pressurized fluid, such as helium, is directed through the fill valve which has a venturi configuration, to draw surrounding ambient air thereinto so that an inflatable article with which the fill valve is associated, may be inflated with a combination of pressurized gas and ambient atmosphere so as to reduce the overall cost involved in the inflating process.

OBJECTS AND SUMMARY OF THE INVENTION

It is an object of the invention to provide a fill valve of the type used with pressurized gas for feeding or supplying a mixture of at least two gases.

It is another object of the invention to provide a fill valve of the type wherein at least two fluids may be intimately intermixed through a venturi configuration for discharge into a nozzle portion thereof.

It is a more specific, important object of the invention to provide a fill valve of the type that may be associated with a superatmospheric pressured supply of gas and wherein actuation of the fill valve causes a second fluid to be drawn into the fill valve by a venturi effect for intimate intermixing and discharge of the at least two fluids.

It is another, even further more specific object of the invention to provide a fill valve of the type for filling inflatable articles wherein the fill valve is attached to a pressurized source of helium which is introduced into the fill valve and actuates same to allow ambient or surrounding air to be drawn within the fill valve so that the helium and air may be intimately intermixed and discharged through a fill nozzle.

It is another, even further more specific important object of the invention to provide a fill valve for filling balloons, and the like, wherein the fill valve is connected to a high pressure source of helium, and actuation of the fill valve permits ambient atmosphere or air to be drawn into the fill valve by reason of a venturi effect so that thereafter, helium and air are intimately intermixed and discharged from the fill nozzle of the fill valve, into the balloon so that the amount of helium necessary to inflate the balloon is substantially reduced.

It is another, even more important and further specific object of the invention to provide a fill valve of the type used in filling balloons with helium wherein helium actuates the fill valve to permit induction of surrounding atmosphere air or gases, and wherein the amount of induced air or gas entering the fill valve for intermixture with the helium is metered in a selectable manner.

Generally, in an exemplary embodiment the invention is directed to a fill valve for at least two fluids, wherein a body member has a fluid pathway therethrough and has an inlet portion adapted for connection to a first fluid under pressure and an outlet portion defining a venturi configuration. The body member has a first orifice communicating the fluid pathway in the exterior of the body member and a second, spaced orifice adapted to communicate said fluid pathway through a second fluid supply. A pneumatically-responsive closure member is operably disposed in fluid-tight relationship on the exterior of said body member adjacent said first orifice and is biased into a first position normally closing said second orifice and a second position opening said second orifice for communication to said second fluid. The last major component of the fill valve is a metering member which is cooperatively associated with a body member to permit selective metering of the second fluid supplied through the second orifice.

These and further objects of the invention become apparent from the hereinafter following commentary taken in conjunction with the figures of drawing.

DESCRIPTION OF THE BEST EMBODIMENTS CONTEMPLATED

Figure 1:
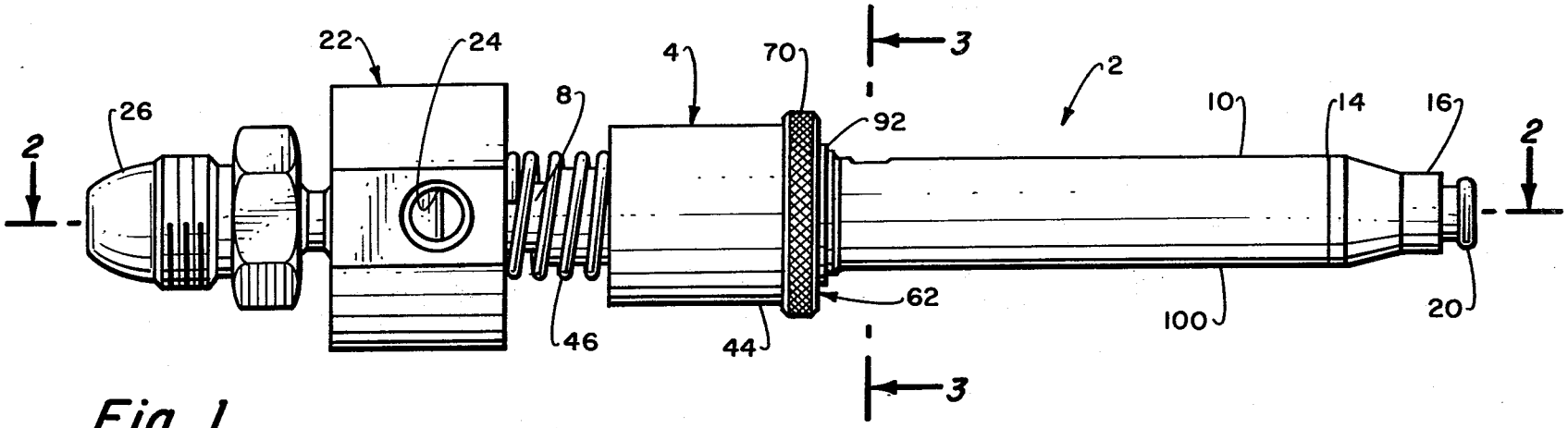
FIG. 1 is a side elevational view of the fill valve of the invention.

As previously indicated, it becomes desirable to be able to mix helium and air, for example, at the time of filling an inflatable article such as a balloon since helium, alone, is quite expensive and to have the air in helium already mixed, substantailly increases the cost of the overall process and, further, since helium and air have different densities, they are not homogeneous and the gases will tend to stratify and will not be as advantageous as being able to fill inflatable articles, such as a baloon, with the fill valve of the invention. The fill valve of the invention is also light, portable of relatively unsophisticated design and could be expected to be substantially maintenance free in operation.

Referring now to the figures of drawing, it will be seen that the fill valve 2 of the invention comprises a body member 4 having a fluid pathway 6 therethrough, and having an inlet portion 8 and an outlet portion 10 wherein the interior wall 12 of the outlet portion defines a venturi configuration, wherein the interior wall 12 flares outwardly towards the terminus 14, and forms an angle between 5° and 8° with respect to the longitudinal axis of body member 4.

The terminus 14 is associated with a nozzle member 16 having interior converging wall 18 and is adapted by means of the lip or end 20 to have associated therewith an article to be inflated, such as a balloon, not shown.

The inlet 8 has a threaded bore to receive manifold connector 22, having a tri-partite configuration. Generally, the gaseous fluid enters at connector 26, exits at orifice 24 and flows through a pressure reducing valve (not shown) and a manual shut-off valve (not shown). The gaseous fluid is then passed into the inlet 28 and thence to the inlet 8. The orifice 24 is adapted to be connected to a timer device, or the like (not shown); whereas, the connector nipple 26 is adapted to be connected to a helium tank or other high pressure gaseous fluid supply source, generally under high pressure, such as about 2400 psig. The remaining inlet 28 is adapted for connection to a pressure regulator or reducer which reduces the pressurized gas from the high pressures under which it is maintained, to about 35 psig.

The inlet portion 8 of the fill valve 2 is threaded as indicated, so as to be able to receive a reduced pressure supply of helium into the axial fluid pathway 6, having an entrance way 30 defining a bore having a reduced intermediate bore or pathway 32 and between which is positioned jet member 34 for purposes that will become apparent as the description proceeds herein. Suffice for the moment, to consider that the pressurized helium entering the bore 30 must pass through the small diameter bore 36 of jet member 34 so as to reduce the pressure and increase the velocity.

The body member 4 is provided with a first orifice or pilot hole 40 of relatively small diameter and spaced therefrom and of larger diameter, is a second orifice or, in this case, air inlet 42, each of the orifices, communicating to the interior fluid pathway 6.

Figure 2:
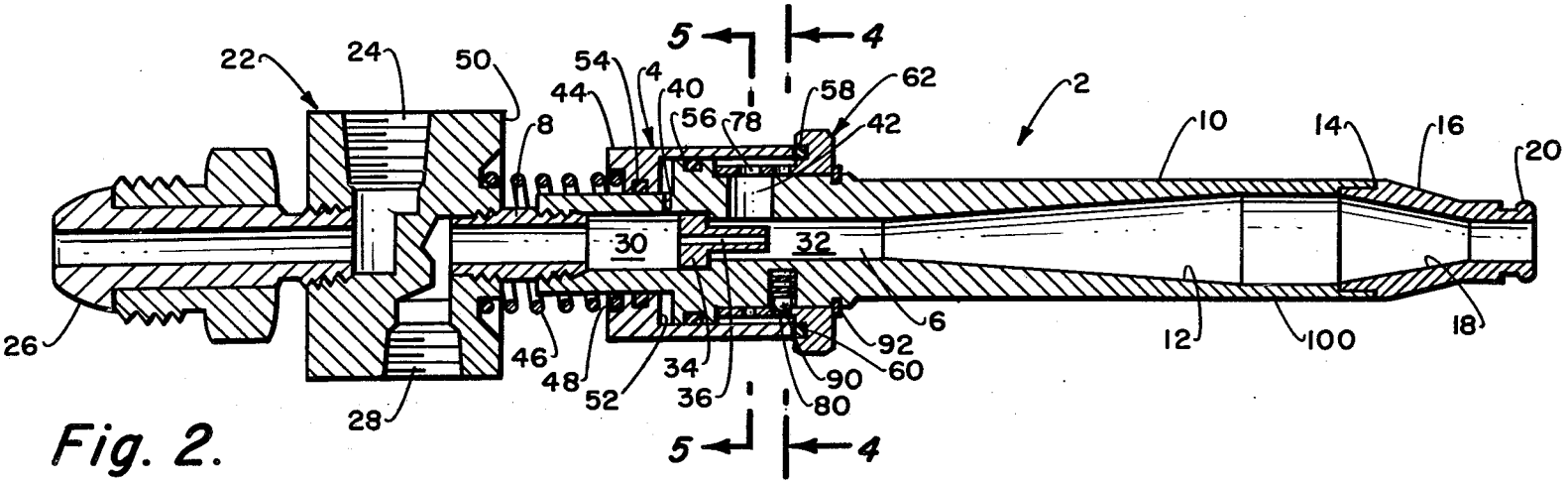
FIG. 2 is a view taken along the line 2—2 of FIG. 1.
Figure 3:
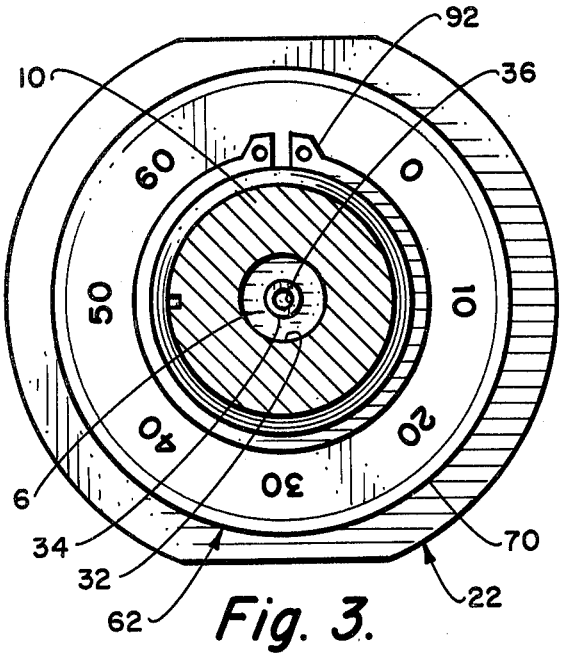
FIG. 3 is a view taken along the line 3—3 of FIG. 1.
Figure 4:
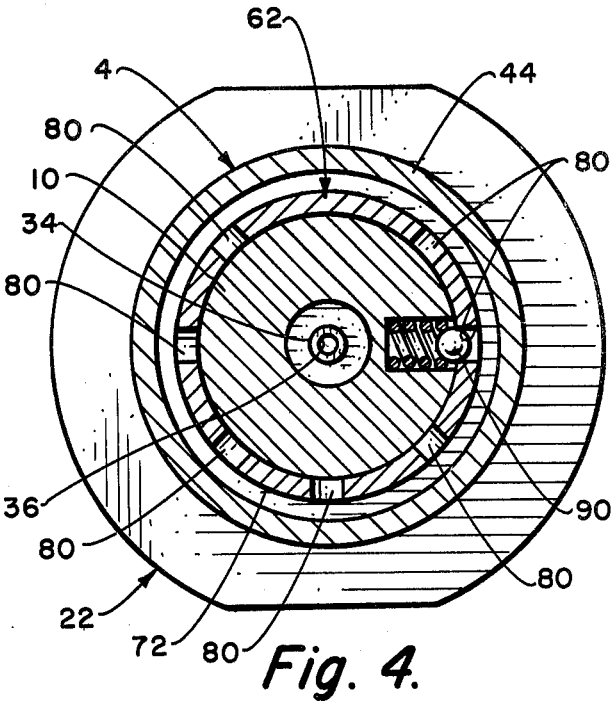
FIG. 4 is a view taken along the line 4—4 of FIG. 2.
Figure 5:
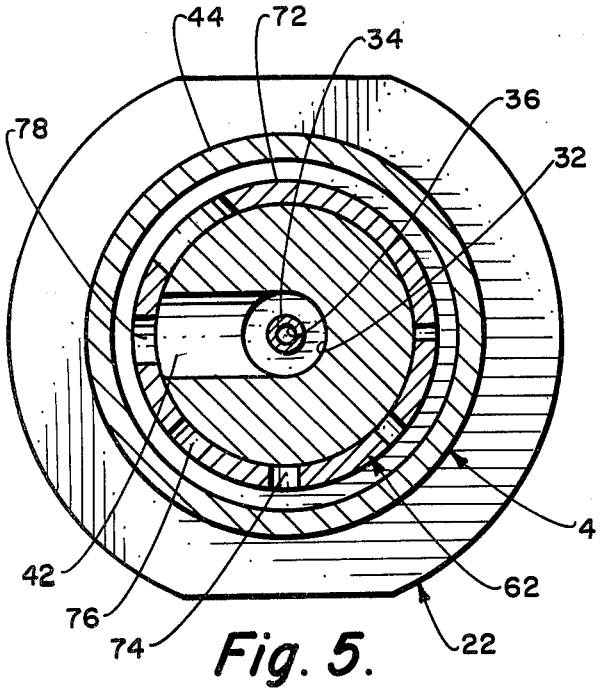
FIG. 5 is a view taken along the line of 5—5 of FIG. 2.

Disposed on the exterior surface of body member 4 is closure or slide member 44 which is biased into the position shown in FIG. 2 by reason of biasing or helical spring 46 acting or abutting against the recess 48 of closure or slide member 44 with the other end of biasing member 46 acting against the end wall 50 of manifold 22.

The closure, or slide member 44 has an interior shoulder 52 upon which pressurized fluid or gas may act as will be detailed hereinafter. The closure member 44 is pneumatically responsive and is in fluid-tight relationship with respect to the exterior of body member 4 and to that end, O-rings 54 and 56 are provided.

The closure or slide member 44, being pneumatically responsive, is in fluid-tight relationship with the first or pilot orifice 40, and the second or air inlet orifice 42 and is shiftable or movable in a fashion to either open the second orifice or air inlet 42 or close same, as seen in FIG. 2. That is, the helical spring 46 exerts a biasing force on the closure member 44 to maintain the closure member in the second orifice sealing position as seen in FIG. 2. However, upon introduction of pressurized gas into the fluid pathway, and more specifcially, the pathway 30, the pressurized gas flows through the first or pilot orifice 40 to act upon the interior shoulder 52 of closure member 44, thereby causing closure member 44 to overcome the spring force of spring 46 and move to the left as seen in FIG. 2, thereby causing the exterior rim or edge 58 of closure member 44 to disengage the O-ring or seal 60 positioned in metering member 62 to open up the air inlet or second orifice 42 to surrounding ambient atmosphere.

Figure 6:
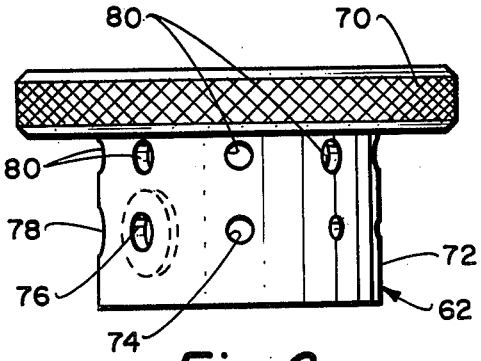
FIG. 6 is an enlarged view of the metering member of the fill valve of the invention.

Disposed adjacent second orifice or air inlet 42, is metering member 62, generally having a knob-like configuration best seen in FIG. 6. The metering member 62 has an exterior knurled knob portion 70 and an innerset, cylindrical barrel portion 72, having a plurality of spaced apertures 74, 76, 78 et seq. of varying diameters and calibrated in order to define the extent of air to pressurized gas or helium mixture that would be ejected through the fill valve 2. That is, the varying size diameter of the orifices 74, 76, 78 et. seq., are directly calibrated so that lesser or more amounts of air are allowed to flow into the fluid pathway 6 and more particularly, into the pathway portion 32 of fill valve member 2.

The exterior surface of the knob 70 is knurled for ease of rotation and the plurality of apertures 80 are aligned with each one of the plurality of metering orifices 74, 76, 78 et. seq. so as to receive spring loaded ball 90 in detent fashion so that the metering member 62 may be indexed between 0 and 60 to thereby have positive alignment and control over the metering orifices 74, 76, 78, et. seq. and the second orifice or air inlet 42. A snap ring 92 completes the assemblage so as to maintain the metering member 62 in cooperative assembly on the body member 4.

In operation of fill valve 2, suitable connections are made to a shut off valve and/or a timing mechanism, if any, and, of course, the helium under high pressure so that a reduced pressure volume of helium may be introduced from the regulator into the inlet 8 of fill valve 2. Introduction of the helium under about 35 psig causes the closure of slide member 44 to become pneumatically responsive and to thereby overcome the biasing force of coil spring 46 to retract the closure member 44 from its closing position over the second orifice or inlet 42. The relatively high pressure helium flowing through the pathway, and more specifically, the orifice 36 of jet member 34, causes a pressure drop thereby decreasing the velocity as it is discharged therefrom, wherein the helium undergoes isentropic expansion and the absolute pressure at the end of jet member 34 and, in particular, in fluid pathway portion 32, drops below atmospheric. Because the closure member has uncovered the second or air inlet orifice 42 and one of the metering ring orifices of metering member 62 is aligned therewith, ambient air at atmospheric pressure is drawn into the helium gas stream and intimately mixed. The mixture of helium and gas continues to flow into the cone angle diffuser section, or venturi area defined by venturi wall 12 which minimizes further pressure drop. Flow continues through a short, straight section 100 of outlet portion 10 and into a 15° cone angle exit section or nozzle 16 into the article to be inflated.

In operation of fill valve 2, the amount of air allowed entry for admixture may vary from 0% and increasing upwardly in 10% increments to 60%. This is easily achieved by merely rotating the metering member 62 through the index positions so that alignment of the particular calibrated aperture, i.e. 74,76, 78, et seq., with air inlet or second orifice 42, is obtained. The detent mechanism 90 engages each position by reason of the superposed and aligned holes 80 provided in the cylindrical portion 72 of metering member 62.

When supply of helium is stopped, the pneumatically actuated slider closure member 44 is urged back into the air inlet closing position by reason of the biasing force exerted by coil spring 46 and into the closed position as seen in FIG. 2.

Thus, there has been disclosed a fill valve or aspirator to be used with at least two fluids, wherein one of the fluids is at superatmospheric pressure and wherein the second fluid may be ambient atmosphere, or the like.

The device of the invention has been described with regard to specific configuration and details of construction, but those of ordinary skill in the art, will at once recognize various changes and modifications. That is, for example while the fill valve 2 has been illustrated as having a separate jet member 34, those of ordinary skill in the art will, of course, recognize that integral construction could be resorted to and still achieve the same effect. Likewise, other changes and modifications will at once present themselves and all such changes and modifications are intended to be covered by the appended claims. Further, while the invention has been described with respect to helium and inflatable articles, it is, of course, apparent that the fill valve of the invention may be used with other gases and may be used for a variety of purposes other than filling balloons, and the like.

I claim:

1. A fill valve for at least two fluids comprising the combination:

a body member having a fluid pathway therethrough and having an inlet portion adapted for connection to a first fluid under pressure, and an outlet portion defining a venturi configuration, said body member having a first orifice communicating said fluid pathway to the exterior of said body member, and a second, spaced orifice adapted to communicate said fluid pathway to a second fluid supply;

a pneumatically responsive closure member operably disposed in fluid tight relationship against the exterior of said body member adjacent said first orifice and being biased into a first position normally closing said second orifice and a second position opening said second orifice for communication to said second fluid; and a metering member cooperatively associated with said body member to selectively meter said second fluid supplied to said second orifice.

2. The fill valve in accordance with claim 1, wherein said fluid pathway is substantially axial with respect to said body member.

3. The fill valve in accordance with claim 1, wherein said closure member is a slidably disposed element having an interior shoulder upon which fluid from said first fluid under pressure may act.

4. The fill valve in accordance with claim 3, wherein said metering member is annular in configuration having a plurality of spaced apertures, selectably indexable with respect to said second spaced orifice.

5. The fill valve in accordance with claim 4, wherein said second orifice is substantially larger in diameter than said first orifice.

6. The fill valve in accordance with claim 4, including a jet member in said fluid pathway having a diameter substantially reducing the fluid pathway positioned just forward of the initial venturi configuration of said outlet portion.

7. The fill valve in accordance with claim 4, wherein the interior wall configuration of said outlet portion flares outwardly toward the terminus thereof and is adapted to induce a venturi effect for fluids under pressure passing through said fluid pathway.

8. The fill valve in accordance with claim 7, including a nozzle member operatively associated with said outlet portion and adapted to cooperate with an article to be filled.

9. The fill valve in accordance with claim 7, wherein said metering member includes a spring loaded ball and detent to permit ease of indexing thereof in a radial fashion with respect to said body member.

10. The fill valve in accordance with claim 7, including a helical spring acting upon said closure member to provide said biasing force.

11. The fill valve in accordance with claim 7, wherein said metering member has spaced apertures in the exterior wall thereof, adapted for alignment positioning with respect to said second orifice.

12. The fill valve in accordance with claim 11, including a manifold member operatively secured to said inlet portion for connection to a first fluid source.

13. The fill valve in accordance with claim 11, wherein said interior wall of said outlet portion in the venturi portion thereof, has an angle of about 5–8 degrees with respect to the longitudinal access of said body member.

14. The fill valve in accordance with claim 13, wherein said nozzle member has a converging tip.

15. The fill valve in accordance with claim 14, wherein said first fluid is super atmosphere pressurized gas and said second fluid is ambient atmosphere and said second orifice, upon retraction of said closure member, is in communication therewith.

16. A fill valve for a least two fluids comprising the combination:

a body member having an axial fluid pathway therethrough and having an inlet portion adapted for connection to a first fluid under pressure, and an outlet protion defining a venturi configuration, said body member having a first orifice communicating said axial fluid pathway to the exterior of said body member, and a second, spaced orifice adapted to communicate said axial fluid pathway to a second fluid supply;

a pneumatically responsive closure member operably and slidably disposed, in fluid tight relationship, on the exterior of said body member adjacent said first orifice and being biased into a first position normally closing said second orifice and a second position opening said second orifice for communication to said second fluid; and an annular metering member having a plurality of spaced apertures cooperatively associated with said body member and being selectably indexable with respect to said second spaced orifice to selectively meter said second fluid supplied to said second orifice, said pneumatically responsive closure element having an interior shoulder upon which fluid from said first fluid under pressure may act.

* * * * *